US007289098B2

(12) United States Patent
Ahn

(10) Patent No.: US 7,289,098 B2
(45) Date of Patent: Oct. 30, 2007

(54) DISPLAY APPARATUS WITH ADJUSTABLE BACKLIGHT UNIT AND CONTROL METHOD THEREOF

(75) Inventor: Yoon-soon Ahn, Seoul (KR)

(73) Assignee: Samsung Electronics Co., Ltd., Suwon (KR)

( * ) Notice: Subject to any disclaimer, the term of this patent is extended or adjusted under 35 U.S.C. 154(b) by 533 days.

(21) Appl. No.: 10/437,924

(22) Filed: May 15, 2003

(65) Prior Publication Data

US 2004/0008177 A1 Jan. 15, 2004

(30) Foreign Application Priority Data

Jul. 10, 2002 (KR) ..... 2002-40098

(51) Int. Cl.
*G09G 3/36* (2006.01)

(52) U.S. Cl. ..... 345/102; 349/61

(58) Field of Classification Search ..... 345/102, 345/690, 211–213; 349/61
See application file for complete search history.

(56) References Cited

U.S. PATENT DOCUMENTS 6,747,708 B2 * 6/2004 Taniai et al. ..... 348/761
6,795,053 B1 * 9/2004 Funamoto et al. ..... 345/102
2002/0180680 A1 * 12/2002 Moon ..... 345/89

FOREIGN PATENT DOCUMENTS

JP 08201812 A * 8/1996
JP 2001-27889 A 1/2001
KR 2002-0039141 A 5/2002

* cited by examiner

*Primary Examiner*—Kent Chang
(74) *Attorney, Agent, or Firm*—Sughrue Mion, PLLC

(57) ABSTRACT

A display apparatus having a backlight unit whose brightness is adjusted according to input image signals. The display apparatus processes input image signals in order for them to be appropriate to a display characteristic in an image signal processing unit and outputs each chromatic signal, R, G, and B, related to a color configuration of the image signals, processed in the chromatic signal output unit. Then a display panel drives an image display screen according to each chromatic signal. Meanwhile, a chromatic averaging unit calculates average brightness of the input images from each chromatic signal to transfer to a controller. The controller controls an inverter through an inverter current limiting unit in order for currents provided to the backlight unit in the display panel, to be controlled according to the average brightness of the input images calculated in the chromatic signal averaging unit.

7 Claims, 3 Drawing Sheets

DISPLAY APPARATUS WITH ADJUSTABLE BACKLIGHT UNIT AND CONTROL METHOD THEREOF

BACKGROUND OF THE INVENTION

1. Field of the Invention

The present invention relates to a display apparatus and a control method thereof, and in particular, to a display apparatus with an adjustable backlight unit and a control method thereof. The present application is based on Korean Patent Application No. 2002-40098, filed Jul. 10, 2002, which is incorporated herein by reference.

2. Description of the Related Art

Since a Liquid Crystal Display (LCD) employs a non-light emitting element, different from a Plasma Display Panel (PDP), a Field Emission Display (FED), etc., it is not possible to use it where light does not exist.

In order to compensate for this defect of the LCD, a backlight unit is developed for illuminating light homogeneously on its information display screen.

FIG. 1 is a block diagram of a conventional Thin Film Transistor (TFT)-LCD with the backlight unit. The TFT-LCD includes an image signal processing unit 10, a chromatic signal output unit 20, a Low Voltage Differential Signaling (LVDS) 30, a TFT-LCD panel 40, an inverter 50, and a controller 60.

The image signal processing unit 10 performs signal processing to satisfy a TFT-LCD characteristic for input image signals.

The chromatic signal output unit 20 outputs an RGB signal to satisfy a characteristic of the TFT-LCD panel 40 from the processed image signals.

The LVDS 30 transmits digital Red (R), Green (G), Blue (B) signals to the TFT-LCD panel 40.

The TFT-LCD panel 40 comprises a LVDS and timing processing unit 41 for processing chromatic signals transferred from the LVDS 30 and controlling timing with the chromatic signals, a DC/DC converter 42 for raising voltages to be provided to a gate driver 46 of the TFT-LCD module 48, which generally requests a high voltage driving power source, a V-com generator 43 for providing voltages to common electrodes of each transistor of the TFT-LCD module 48, a gamma correction unit 44 for controlling brightness and color coordinates, etc., in order to correct a difference between the display characteristic of the TFT-LCD and the human visual perception characteristic for the gray scale of the image signals, a source driver 45 for transferring voltages of gray scale according to image data to source electrodes of each transistor (not shown) which consists each pixel of the TFT-LCD module 48, a gate driver 46 for driving gates of the transistors consisting each pixel of the TFT-LCD module 48, the TFT-LCD module 48 for displaying images by means of transistors activated by signals transferred through the gate driver 46, and a backlight unit 47 for illuminating the light on the image display screen of the TFT-LCD module 48.

The inverter 50 provides driving currents to the backlight unit 47 of the TFT-LCD panel in response to a control signal output from the controller 60.

The controller 60 controls an overall display apparatus in order to enable the transferred image signals to be displayed on the image display screen through the TFT-LCD module 48, and in particular, controls the inverter 50 in order to drive the backlight unit 47 illuminating the light on the image display screen of the TFT-LCD module 48.

As described above, in the conventional TFT-LCD, the backlight unit 47 illuminates the light on the image display screen using currents provided through the inverter 50, and a user can see the image via the image display screen due to the illuminated light.

However, since the currents are designed to be provided constantly to the backlight unit 47 via the inverter 50 in the conventional TFT-LCD, the light is only to be constantly illuminated on the TFT-LCD module in a predetermined amount. Consequently, there occur problems in that the brightness of the input image signals is not controlled efficiently. That is, relatively better quality of the display can be provided by providing more currents to the backlight unit to raise the brightness when the amount of reproduced signals in the LCD is small and limiting maximum currents provided to the backlight unit when the amount of reproduced signals in the LCD is large. However, since the currents provided to the backlight unit through the inverter remain constant, the quality of the display image can be deteriorated.

SUMMARY OF THE INVENTION

It is, therefore, an object of the present invention to provide a display apparatus with an adjustable backlight unit and a method for controlling the backlight unit according to the lightness of input image signals in order to be displayed with an improved quality.

To achieve the above objects, there is provided a display apparatus with an adjustable backlight unit according to an aspect of the present invention, including: an image signal processing unit for processing input image signals in order to satisfy a display characteristic; a chromatic signal output unit for outputting each chromatic signal related to the color configuration of the input images from the processed input image signals in the image signal processing unit; a display panel for driving an image display screen according to each chromatic signal output from the chromatic signal output unit, comprising a backlight unit for illuminating light on the image display screen; a chromatic signal averaging unit for being provided with each chromatic signal from the chromatic signal output unit and calculating average brightness of the input images from each chromatic signal; an inverter for switching currents to the backlight unit included in the display panel; an inverter current limiting unit for limiting the currents provided to the backlight unit; and a controller for controlling the inverter current limiting unit in order for an amount of the currents provided to the backlight unit to be adjusted through the inverter according to the average brightness of the input images calculated in the chromatic signal averaging unit. Here, each chromatic signal is R, G, and B.

The controller controls the inverter current limiting unit in order for the amount of currents provided to the backlight unit in an inverse proportion to the average brightness of the input image transferred from the chromatic signal averaging unit, and within a predetermined range of brightness of the input image.

To achieve the above objects, there is provided a method for controlling a display apparatus according to another aspect of the present invention, including the steps of; extracting each chromatic signal consisting of images from input image signals; calculating average brightness of the input images from the extracted chromatic signals; and adjusting an amount of currents provided to the backlight according to the average brightness of the input image. Here, each chromatic signal is R, G, and B.

The step (c) controls the amount of currents provided to the backlight unit in an inverse proportion to the average brightness of the input image, and within a predetermined range of brightness of the input image.

To achieve the above objects, there is provided a display apparatus with an adjustable backlight unit according to another aspect of the present invention, including; an image signal processing unit for processing input image signals in order to satisfy a display characteristic; a chromatic signal output unit for outputting each chromatic signal related to a color configuration of the input images from the processed input image signals in the image signal processing unit; a display panel for driving an image display screen according to each chromatic signal output from the chromatic signal output unit, comprising a backlight unit for illuminating light on the image display screen; a chromatic signal averaging unit for being provided with each chromatic signal from the chromatic signal output unit and calculating average brightness of the input image from each chromatic signal; an inverter for switching currents provided to the backlight unit included in the display panel; and an inverter current limiting unit for limiting currents provided to the backlight unit according to the average brightness of the input images calculated in the chromatic signal averaging unit.

According to the display apparatus and the control method thereof of the present invention, an image with relatively better quality can be provided to a user by controlling the lightness of the backlight unit used to display images on the screen in response to the input image signals.

BRIEF DESCRIPTION OF THE DRAWINGS

The above and other objects, features and advantages of the present invention will become more apparent from the following detailed description when taken in conjunction with the accompanying drawings in which.

DETAILED DESCRIPTION OF THE PREFERRED EMBODIMENT

A preferred embodiment of the present invention will be described herein below with reference to the accompanying drawings. In the following description, well-known functions or constructions are not described in detail since they would obscure the invention in unnecessary detail.

Figure 1:
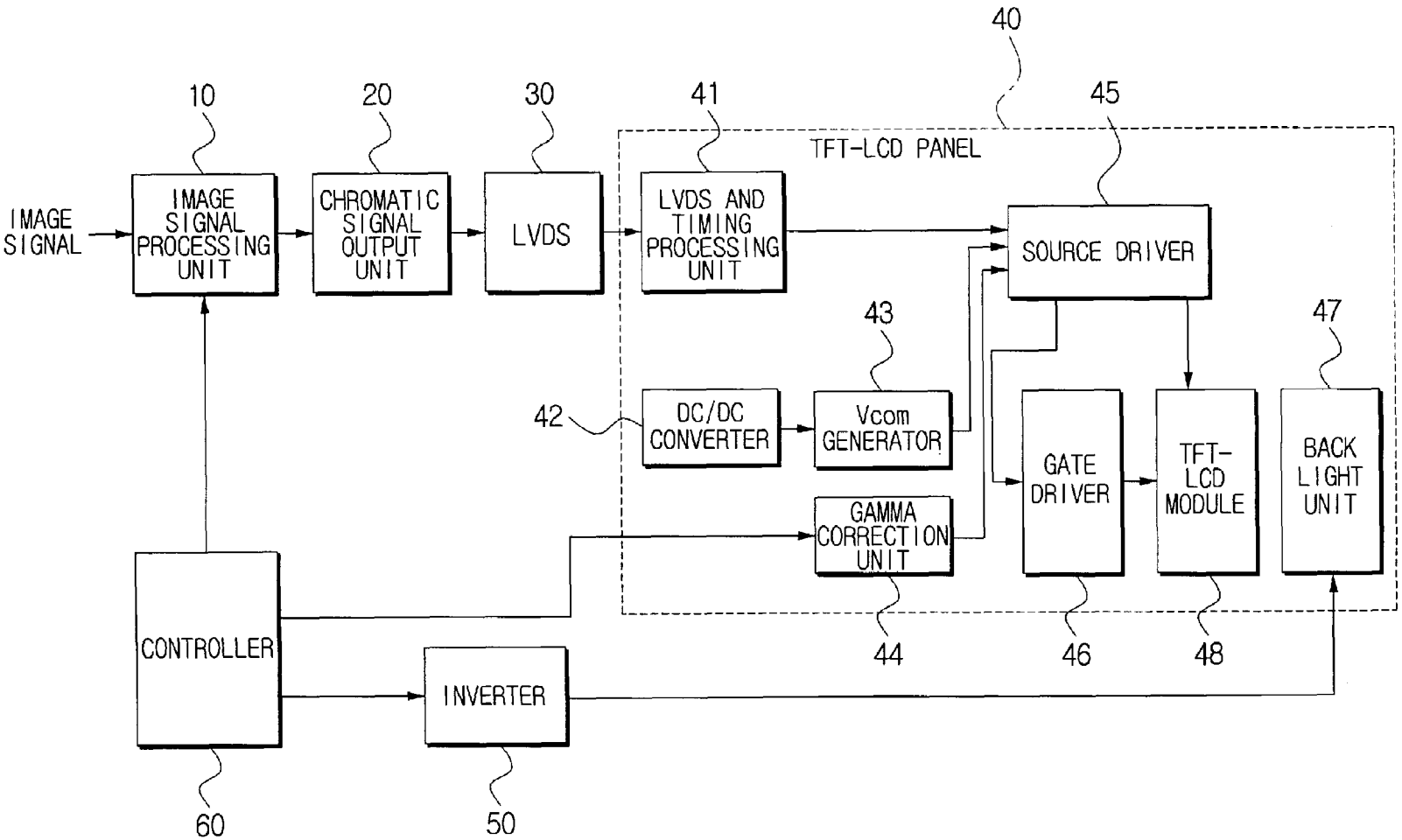
FIG. 1 (PRIOR ART)
FIG. 1 is a schematic block diagram for a conventional display apparatus.
Figure 2:
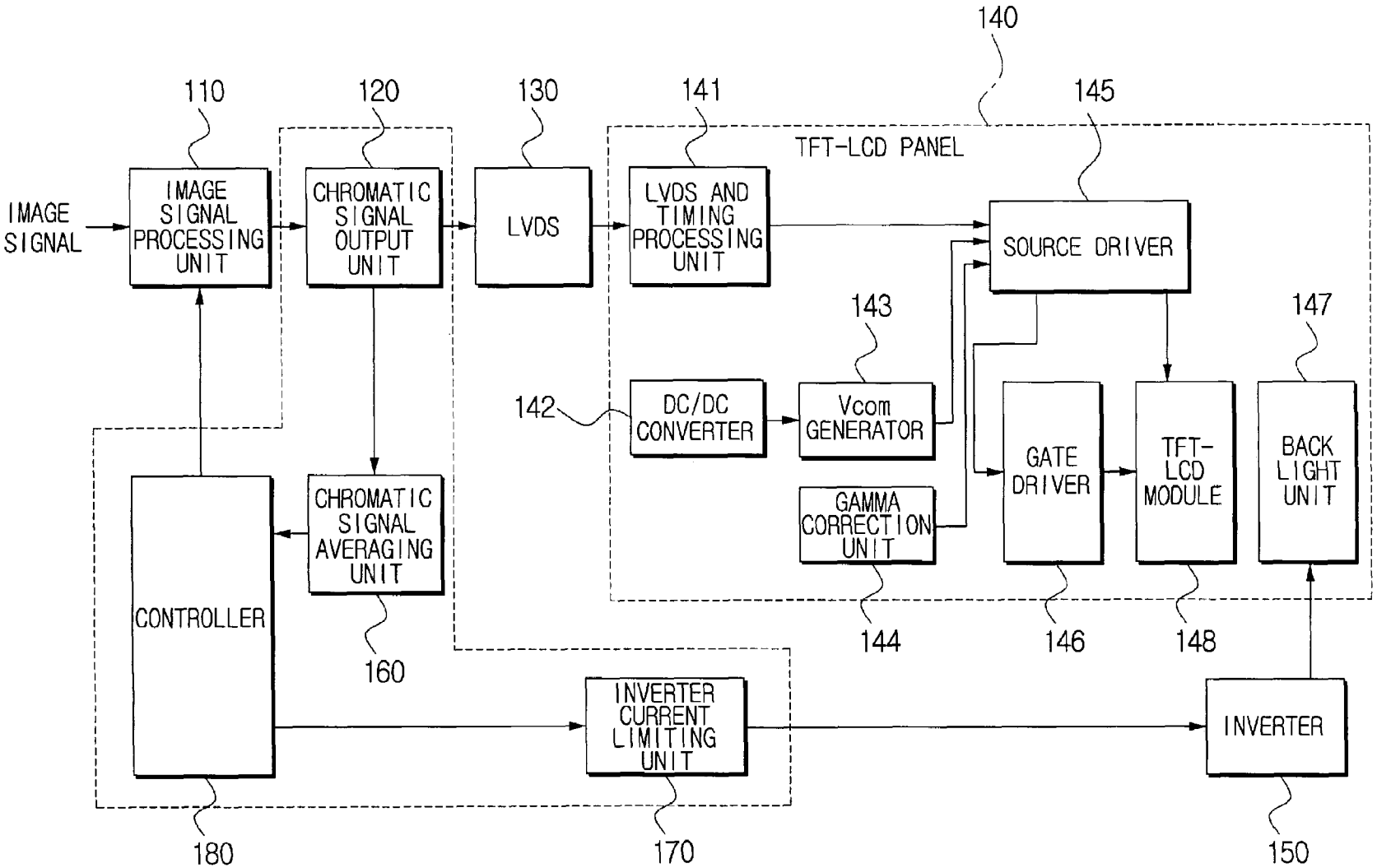
FIG. 2 is a schematic block diagram for a display apparatus according to an embodiment of the present invention.

FIG. 2 is a schematic block diagram of a TFT-LCD with a backlight unit according to an embodiment of the present invention. The display apparatus comprises an image signal processing unit 110, a chromatic signal output unit 120, an LVDS 130, a TFT-LCD panel 140, an inverter 150, a chromatic signal averaging unit 160, an inverter current limiting unit 170 and a controller 180.

The image signal processing unit 110 performs signal processing in order to satisfy a TFT-LCD characteristic for input image signals.

The chromatic signal output unit 120 outputs RGB signals in order to satisfy the TFT-LCD characteristic for the processed image signals.

The LVDS 130 transmits digital RGB signals to the TFT-LCD panel 140.

The TFT-LCD panel 140 comprises an LVDS and timing processing unit 141 for processing chromatic signals transferred from the LVDS 130 and controlling timing with the chromatic signals, a DC/DC converter 142 for raising voltages to be provided to a gate driver 146 of the TFT-LCD module 148, which generally requests a high voltage driving source, a V-com generator 143 for providing voltages to common electrodes of each transistor (not shown) of the TFT-LCD module 148, a gamma correction unit 144 for controlling brightness, color coordinates, etc., in order to correct a difference between a display characteristic of the TFT-LCD and a human visual perception characteristic for the gray scale of the image signals, a source driver 145 for transferring gray scale voltages according to image data to source electrodes of each transistor (not shown) which consists each pixel of the TFT-LCD module 148, a gate driver 146 for driving gates of the transistors consisting each pixel of the TFT-LCD module 148, the TFT-LCD module 148 for displaying images by means of transistors activated by signals transferred through the gate driver 146, and a backlight unit 147 for illuminating the light on an image display screen of the TFT-LCD module 148.

The inverter 150 provides driving currents to the backlight unit 147 of the TFT-LCD panel 140 in response to a control signal output from the controller 180.

The chromatic signal averaging unit 160 is provided with each chromatic signal (R, G, B) related to a color configuration of the image from the chromatic signal output unit 120 to calculate an average brightness of the input image from the gray scale values of each chromatic signal.

The inverter current limiting unit 170 limits currents provided to the inverter 150.

The controller 180 controls the overall display apparatus in order to enable the transferred image signals to be displayed on the image display screen through the TFT-LCD module 148, and in particular, controls the inverter current limiting unit 170 in order to adjust an amount of the currents provided to the backlight unit 147 through the inverter 150 according to the average brightness of the input image calculated at the chromatic signal averaging unit 160.

When the image signals are input, the above TFT-LCD performs signal processing such as gamma correction, contrast, light and darkness, color, etc., at the image signal processing unit 110 to output the processed results to the chromatic signal output unit 120 under the control of the controller 180 on the basis of contents set up by a user and the TFT-LCD characteristic. Then, the chromatic signal output unit 120 outputs each chromatic signal as digital signals for configuring images from the processed image signals in the image signal processing unit 110. Typically, the chromatic signals of R, G, and B are output. Each chromatic signal is transferred to the TFT-LCD panel 140 via the LVDS 130. The TFT-LCD panel 140 drives the source driver 145 and the gate driver 146 according to address information included in the chromatic signals. Accordingly, each transistor of the TFT-LCD module 148 is activated to display the input image on the screen.

Meanwhile, each chromatic signal is transferred to the chromatic signal averaging unit 160. The chromatic signal averaging unit 160 calculates the average brightness of the input image from the gray scale values of each chromatic signal to output to the controller 180. Then, the controller 180 controls the inverter current limiting unit 170 according to the transferred average brightness of the input image. That is, the controller 180 controls the inverter current limiting unit 170 in order for the amount of currents provided to the backlight unit 147 to be increased when the average brightness of the input image transferred from the chromatic signal averaging unit 160 gets low, and to be decreased when the average brightness of the input image gets high. It is determined that the average brightness of the input image is low when the average brightness of an image for a specified backlight brightness is below a threshold level which is determined by experimentation or observation. Experimentation on human visual perception or observation provides a threshold level below which humans perceive an image as being too dark, and above which humans perceive the image as being too bright. Alternatively, a threshold level is determined through experimentation on or observation of display images perceived by humans as having a better quality over images displayed on a conventional TFT-LCD. The inverter 150 provides voltages to the backlight unit 147 according to the control of the controller 180 through the inverter current limiting unit 170. The amount of the light illuminated to the TFT-LCD module 148 in the backlight unit 147 is changed according to the provided current.

Consequently, the image display panel in the display apparatus is driven according to the input image signals. On the other hand, since the brightness of the backlight unit 147 is adjusted automatically, the image is displayed on the image display screen in more improved quality.

Figure 3:
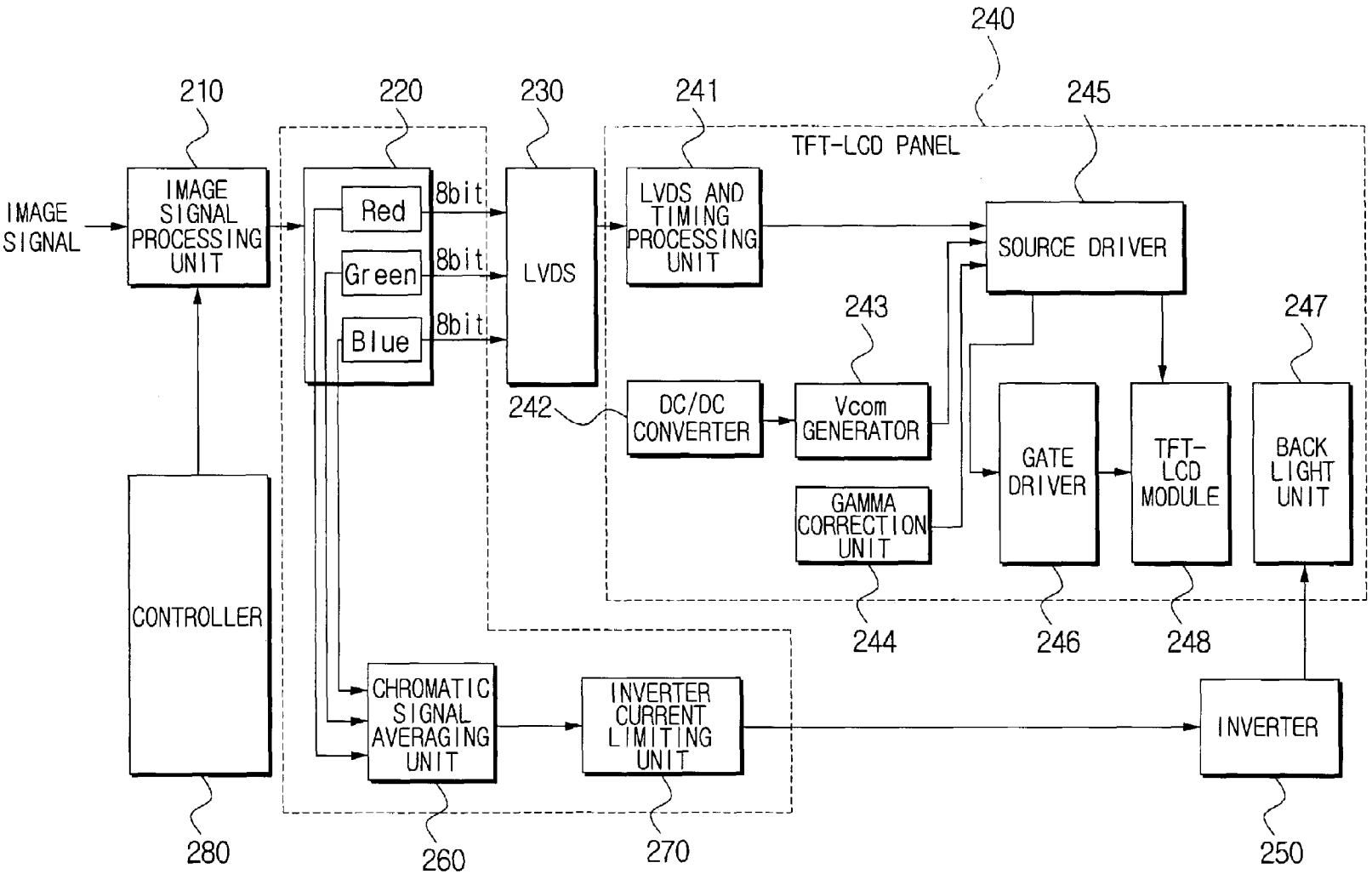
FIG. 3 is a schematic block diagram for a display apparatus according to another embodiment of the present invention.

FIG. 3 is a schematic block diagram for a display apparatus according to another embodiment of the present invention. The display apparatus is almost similar to the display apparatus as shown in FIG. 2 in configuration, but is configured to control the inverter current limiting unit 270 directly according to the average brightness of the input image calculated in the chromatic signal averaging unit 260, and not to have the inverter current limiting unit 270 controlled by the controller 280.

In order for the inverter current limiting unit 270 to be controlled directly by the chromatic signal averaging unit 260, it is needed that the chromatic averaging unit 260 further comprises a digital to analog converter (not shown), etc. By driving the inverter current limiting unit 270 directly without the control of the controller 280, mis-operations caused by an abnormality of the controller 280 can be prevented.

According to the display apparatus of the present invention, the brightness of the backlight unit is adjusted in response to the input image signals. Therefore, it can provide more improved quality of the image to a user to raise a degree of satisfaction of usage.

While the invention has been shown and described with reference to a certain preferred embodiment thereof, it will be understood by those skilled in the art that various changes in form and details may be made therein without departing from the spirit and scope of the invention as defined by the appended claims and their equivalents.

What is claimed is:

1. A display apparatus comprising;

an image signal processing unit for processing an input image signal of an input image in order to satisfy a display characteristic, thereby to produce a processed input image signal;

a chromatic signal output unit which is provided with the processed input image signal and which outputs a chromatic signal related to a color configuration of the input image;

a display panel for driving an image display screen according to the chromatic signal output from the chromatic signal output unit, having a backlight unit for providing illuminating light on the image display screen;

a chromatic signal averaging unit which is provided with the chromatic signal from the chromatic signal output unit and which calculates an average brightness of the input image from the chromatic signal;

an inverter for switching a current to the backlight unit included in the display panel;

an inverter current limiting unit for limiting the current provided to the backlight unit; and a controller for controlling the inverter current limiting unit in order for an amount of the current provided to the backlight unit to be adjusted through the inverter according to the average brightness of the input image calculated in the chromatic signal averaging unit, wherein the inverter current limiting unit limits the current provided to the backlight unit by limiting the current provided to the inverter.

2. The display apparatus according to claim 1, wherein the chromatic signal comprises R, G, and B signals.

3. The display apparatus according to claim 1, wherein the controller controls the inverter current limiting unit in order for the amount of the current provided to the backlight unit in an inverse proportion to the average brightness of the input image transferred from the chromatic signal averaging unit, and within a predetermined range of brightness of the input image.

4. The display apparatus according to claim 3, wherein the average brightness is determined to be low when the average brightness is below a predetermined threshold level and the average brightness gets high when the average brightness is above the predetermined threshold level.

5. A display apparatus comprising;

an image signal processing unit for processing an input image signal of an input image in order to satisfy a display characteristic thereby to produce a processed image signal;

a chromatic signal output unit which is provided with the processed input image signal and which outputs a chromatic signal related to a color configuration of the input image;

a display panel for driving an image display screen according to the chromatic signal output from the chromatic signal output unit, comprising a backlight unit for providing illuminating light on the image display screen;

a chromatic signal averaging unit which is provided with the chromatic signal from the chromatic signal output unit and which calculates an average brightness of the input image from the chromatic signal;

an inverter for switching a current to the backlight unit included in the display panel; and an inverter current limiting unit for limiting the current provided to the backlight unit according to the average brightness of the input image calculated in the chromatic signal averaging unit, wherein the inverter current limiting unit limits the current provided to the backlight unit by limiting the current provided to the inverter.

6. A display apparatus comprising;

an image signal processing unit for processing an input image signal of an input image in order to satisfy a display characteristic, thereby to produce a processed input image signal;

a chromatic signal output unit which is provided with the processed input image signal and which outputs a chromatic signal related to a color configuration of the input image;

a display panel for driving an image display screen according to the chromatic signal output from the chromatic signal output unit, having a backlight unit for providing illuminating light on the image display screen;

a chromatic signal averaging unit which is provided with the chromatic signal from the chromatic signal output unit and which calculates an average brightness of the input image from the chromatic signal;

an inverter for switching a current to the backlight unit included in the display panel;

an inverter current limiting unit for limiting the current provided to the backlight unit; and a controller for controlling the inverter current limiting unit in order for an amount of the current provided to the backlight unit to be adjusted through the inverter according to the average brightness of the input image calculated in the chromatic signal averaging unit, wherein the chromatic signal comprises R, G, and B signals, and the chromatic signal averaging unit calculates the average brightness of the input image from the chromatic signal from gray scale values of each of the R, G and B signals.

7. A display apparatus comprising;

an image signal processing unit for processing an input image signal of an input image in order to satisfy a display characteristic thereby to produce a processed image signal;

a chromatic signal output unit which is provided with the processed input image signal and which outputs a chromatic signal related to a color configuration of the input image;

a display panel for driving an image display screen according to the chromatic signal output from the chromatic signal output unit, comprising a backlight unit for providing illuminating light on the image display screen;

a chromatic signal averaging unit which is provided with the chromatic signal from the chromatic signal output unit and which calculates an average brightness of the input image from the chromatic signal;

an inverter for switching a current to the backlight unit included in the display panel; and an inverter current limiting unit for limiting the current provided to the backlight unit according to the average brightness of the input image calculated in the chromatic signal averaging unit, wherein the chromatic signal comprises R, G, and B signals and wherein the chromatic signal averaging unit calculates the average brightness of the input image from the chromatic signal from gray scale values of each of the R, G and B signals.

* * * * *